US007301425B2

(12) United States Patent
Ko et al.

(10) Patent No.: US 7,301,425 B2
(45) Date of Patent: Nov. 27, 2007

(54) PANCAKE TYPE BIFILAR WINDING MODULE USING HIGH-TC SUPERCONDUCTING WIRE AND BOBBIN FOR WINDING THEREFOR

(75) Inventors: Tae Kuk Ko, Seoul (KR); Duck Kwon Bae, Cheonan-si (KR); Min Cheol Ahn, Paju-si (KR)

(73) Assignee: Industry-Academic Cooperation Foundation, Yonsei University, Seoul (KR)

( * ) Notice: Subject to any disclaimer, the term of this patent is extended or adjusted under 35 U.S.C. 154(b) by 75 days.

(21) Appl. No.: 11/372,969

(22) Filed: Mar. 10, 2006

(65) Prior Publication Data

US 2006/0202787 A1 Sep. 14, 2006

(30) Foreign Application Priority Data

Mar. 11, 2005 (KR) ..... 10-2005-0020612

(51) Int. Cl.
*H01F 6/00* (2006.01)

(52) U.S. Cl. ..... 335/216; 336/198; 336/DIG. 1; 505/705; 505/706; 505/879; 505/880

(58) Field of Classification Search ..... 505/211, 505/220, 705, 706, 879, 880, 924; 335/216; 336/198, DIG. 1
See application file for complete search history.

(56) References Cited

U.S. PATENT DOCUMENTS 3,559,128 A * 1/1971 Kingston et al. ..... 335/216
5,332,989 A * 7/1994 Ching ..... 336/208

FOREIGN PATENT DOCUMENTS

JP 61082403 A * 4/1986

* cited by examiner

*Primary Examiner*—Ramon M. Barrera
(74) *Attorney, Agent, or Firm*—Sheridan Ross P.C.

(57) ABSTRACT

The present invention discloses a pancake-type bifilar winding module using a superconducting wire and a winding bobbin therefor. The pancake-type bifilar winding module includes (a) a bobbin having (i) a cylindrical main body having a wire insertion groove for winding a superconducting wire in a bifilar manner to have the least inductance, in which the wire insertion groove has a depth greater than the width of the superconducting wire and a radius of curvature greater than a predetermined value, and is structured to guide the superconducting wire from one side to another side of the body, and (ii) a cylindrical supporting base having at least one block fixing notch and being disposed under the main body, (b) the superconducting wire wound in a bifilar manner, maintaining a predetermined tension as it is disposed in the wire insertion groove of the bobbin and curved in the middle portion thereof in the longitudinal direction, and (c) a copper block serving as an electrical terminal, which is installed and fixed to the block fixing notch of the supporting base of the bobbin for joining the superconducting wire with a terminal portion, and joined with the superconducting wire while the superconducting wire maintains a predetermined tension.

10 Claims, 7 Drawing Sheets

PANCAKE TYPE BIFILAR WINDING MODULE USING HIGH-TC SUPERCONDUCTING WIRE AND BOBBIN FOR WINDING THEREFOR

BACKGROUND OF THE INVENTION

1. Field of the Invention

The present invention relates to a pancake-type bifilar winding module using a superconducting wire and a winding bobbin therefor. More particularly, the present invention relates to a pancake-type bifilar winding module for use in manufacturing a superconducting fault current limiter, and a winding bobbin capable of enabling bifilar winding of a superconducting wire by accommodating the characteristic of the superconducting wire, such as the curvature of the superconducting wire.

2. Description of the Related Art

A superconductor is a synthetic material that has superconductivity under predetermined conditions. In particular, the superconductor has very low or no electrical resistance under predetermined conditions of temperature, intensity of magnetic field, and current density, but it exhibits high resistance when conditions such as quench phenomena, superconductivity phase transition, and normal conductivity phase transition are changed.

Due to these characteristics, if superconducting elements are inserted into a power system in series, no electrical loss occurs since the resistance of the superconductor is zero during normal operation of the power system. However, the superconductor has high resistance when the power system fails since the fault current exceeds the critical current of the superconductor. Due to the increased resistance of the superconductor, the fault current is limited. Accordingly, this system is called a superconducting fault current limiter.

A superconducting fault current limiter is a piece of power machinery used to prevent power interruption by effectively limiting over-current generated by a short-circuit or the disconnection of a circuit, and is considered as the only substitute which can overcome the limitations of a circuit breaker which has been used in current power systems so far.

This superconducting fault current limiter has been manufactured using various kinds of superconductors. Prevalent superconductors are a thin film, a thick film, and a bulk device.

However, these superconductors have the following disadvantages. First, it is difficult to modify their size and shape. Second, the fault current limiter must be structured to have minimal inductance, but they are difficult to construct to have a small inductance. Third, there are limitations in manufacturing of the thin film, the thick film, and the bulk device compared to a wire. Furthermore, it is difficult to purchase them, and they are expensive.

SUMMARY OF THE INVENTION

Accordingly, the present invention has been made keeping in mind the above problems occurring in the related art, and an object of the present invention is to provide a pancake-type bifilar winding module using a superconducting wire. the superconducting wire, which can be easily manufactured, purchased, and modified in the aspects of it's capacity and size is used, so that the pancake-type bifilar winding module is used to manufacture a superconducting fault current limiter, which is structured to have the lowest possible inductance, and a winding bobbin is provided therefor.

In order to achieve the above object, according to one aspect of the present invention, there is provided a bifilar winding module, particularly a pancake-type bifilar winding module comprising (a) a bobbin including (i) a cylindrical main body having a wire insertion groove for winding a superconducting wire in a bifilar manner to have the least inductance, in which the wire insertion groove has a depth greater than a width of the superconducting wire and a radius of curvature greater than a predetermined value, and is structured to guide the superconducting wire from one side to another side of the body, and (ii) a cylindrical supporting base having at least one block fixing notch and being disposed under the main body, (b) the superconducting wire wound in a bifilar manner, maintaining a predetermined tension as it is disposed in the wire insertion groove of the bobbin and curved in the middle portion thereof in the longitudinal direction, and (c) a copper block serving as an electrical terminal, which is installed and fixed to the block fixing notch of the supporting base of the bobbin for joining the superconducting wire with a terminal portion, and joined with the superconducting wire while the superconducting wire maintains a predetermined tension.

In order to achieve the object of the present invention, according to another aspect of the present invention, there is provided a pancake-type bifilar winding module, comprising a plurality of bifilar winding modules, each including (a) a bobbin including (i) a cylindrical main body having a wire insertion groove for winding a superconducting wire in a bifilar manner to have minimal inductance, in which the wire insertion groove has a depth greater than the width of the superconducting wire and a radius of curvature greater than a predetermined value, and is structured to guide the superconducting wire from one side to another side of the body, and (ii) a cylindrical supporting base having at least one block fixing notch and being disposed under the main body, (b) the superconducting wire wound in a bifilar manner, maintaining a predetermined tension as it is disposed in the wire insertion groove of the bobbin and curved in the middle portion thereof in the longitudinal direction, and (c) a copper block serving as an electrical terminal, which is installed and fixed to the block fixing notch of the supporting base of the bobbin for joining the superconducting wire with a terminal portion, and joined with the superconducting wire while the superconducting wire maintains a predetermined tension, wherein the bifilar winding modules are stacked in a vertical direction such that the supporting base of an upper bifilar winding module is in contact with the main body of the bobbin of a lower bifilar winding module, so that windings are connected in series and thereby the length of the winding can be increased.

In order to achieve the object of the present invention, according to a further aspect of the present invention, there is provided a winding bobbin used for bifilar winding in a pancake-type bifilar winding module using a superconducting wire, comprising (a) a cylindrical main body having a wire insertion groove for winding a superconducting wire in a bifilar manner to have minimal inductance, in which the wire insertion groove has a depth greater than the width of the superconducting wire and a radius of curvature greater than a predetermined value, and is structured to guide the superconducting wire from one side to another side of the body, (b) a cylindrical supporting base having at least one block fixing notch and being disposed under the main body, and (c) a copper block serving as an electrical terminal, which is installed and fixed to the block fixing notch of the supporting base for joining the superconducting wire with a terminal portion.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
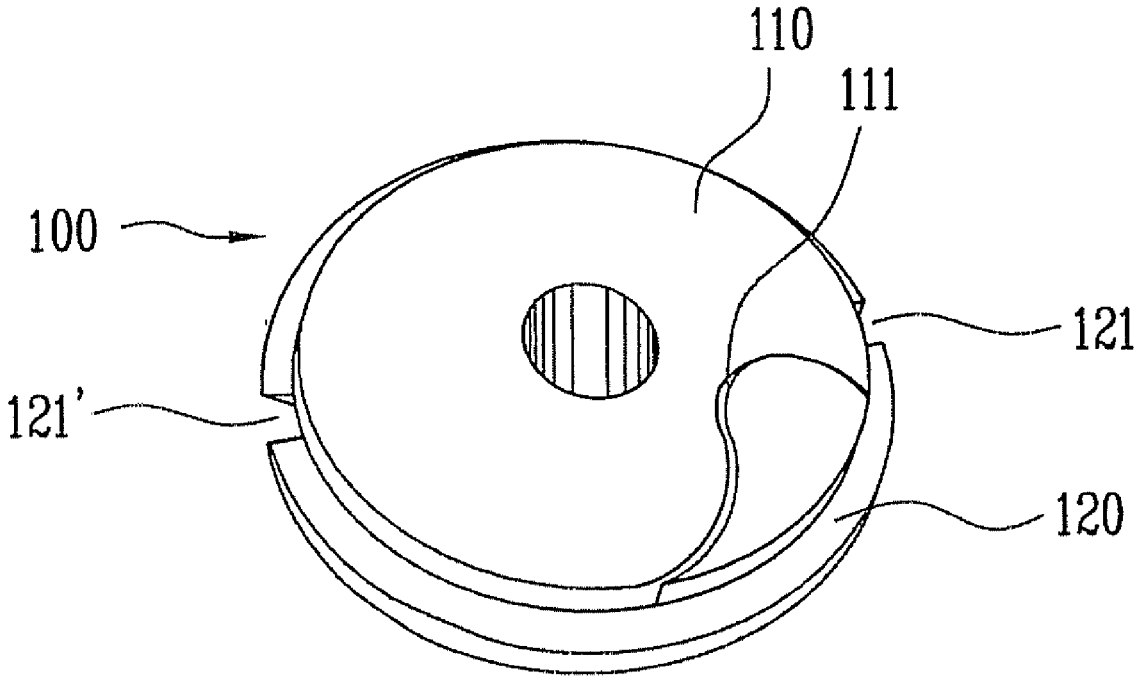
FIG. 1 is a perspective view illustrating a winding bobbin for a bifilar winding, according to one embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

The word "winding" means a combination of a turn and a coil which has a limited function in an electrical apparatus, and the word "bifilar winding" means a winding made by two closely spaced conductors in which the two conductors are connected so as to carry current in opposite directions, so that the inductance of the winding is negligible.

Figure 2:
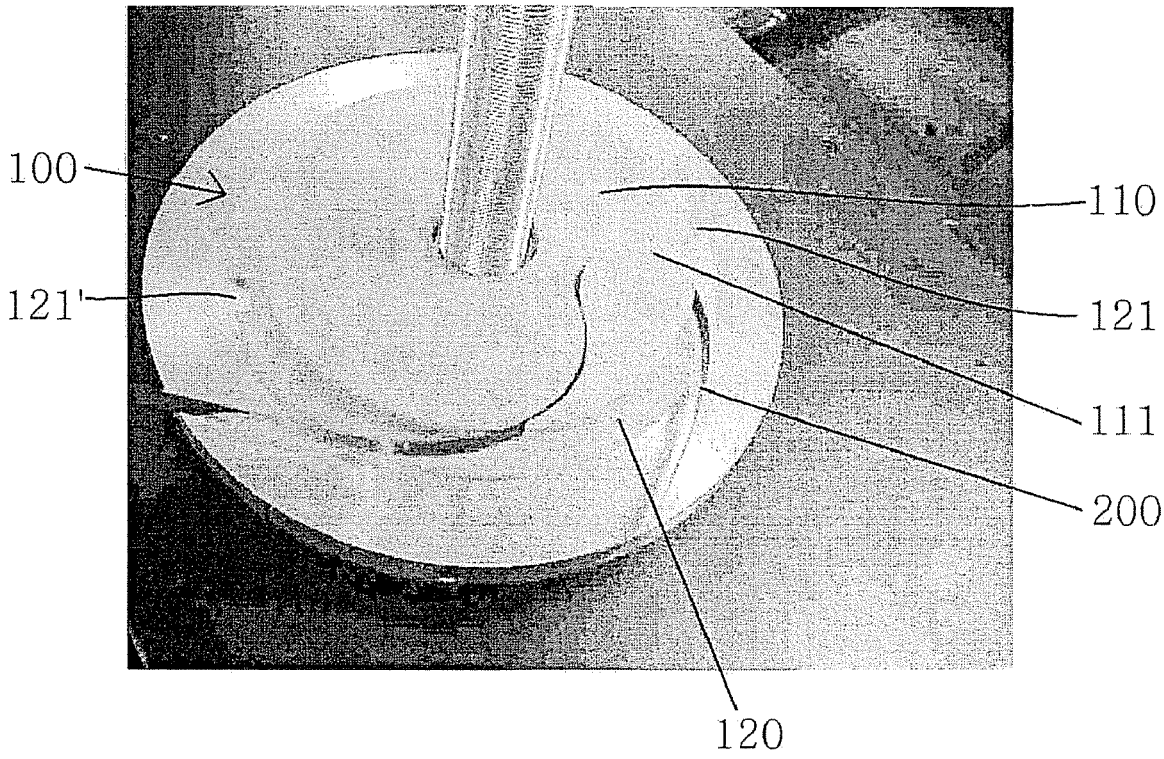
FIG. 2 is a photograph illustrating the state in which a superconducting wire is fixed to the winding bobbin illustrated in FIG. 1.
Figure 3:
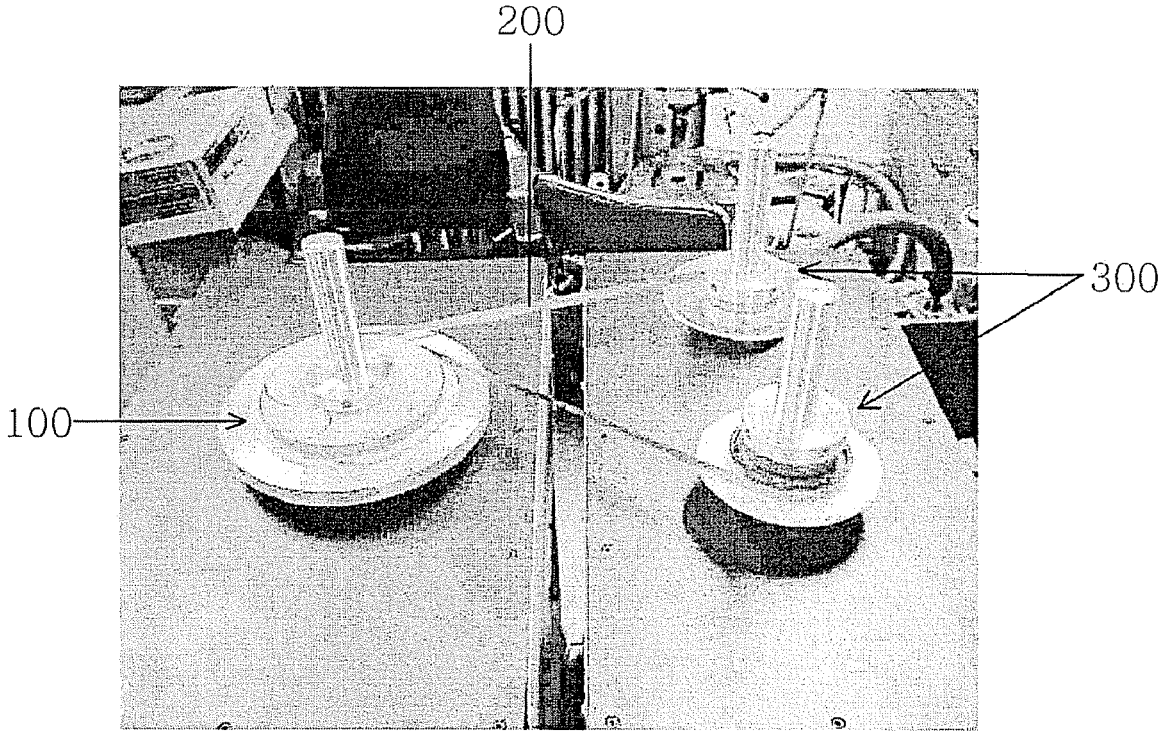
FIG. 3 is a photograph illustrating the state in which a superconducting wire is wound around the winding bobbin using a winding machine.
Figure 4:
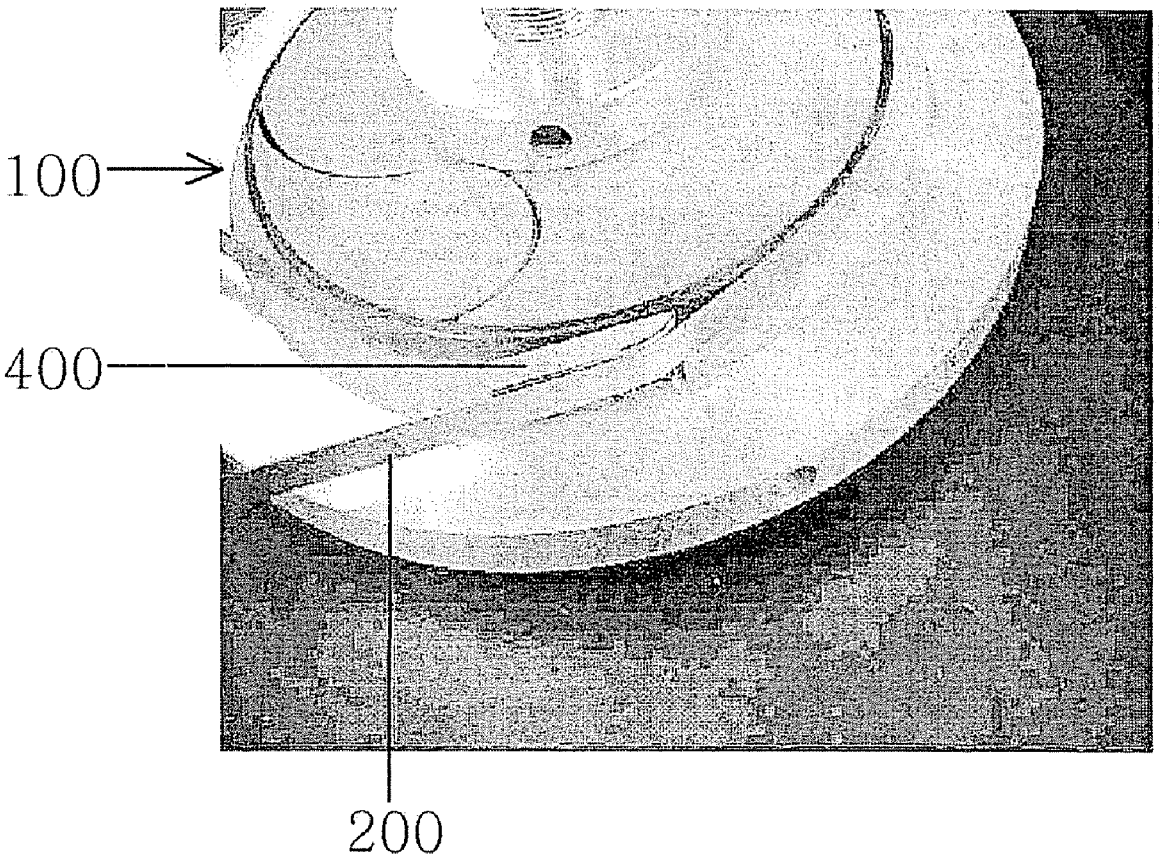
FIG. 4 is a photograph illustrating the state in which a copper block serving as a current terminal is joined with the winding bobbin.

FIG. 1 illustrates the structure of a winding bobbin for a bifilar winding, according to one embodiment of the present invention, FIG. 2 illustrates the state in which a superconducting wire is fixed to the winding bobbin illustrated in FIG. 1, FIG. 3 illustrates the superconducting wire in the state of being wound around the winding bobbin using winding machines, and FIG. 4 illustrates a copper block serving as a current terminal in the state of being joined with the winding bobbin.

Referring to FIG. 1, the winding bobbin used for bifilar winding of a superconducting wire comprises a main body 110 and a supporting base 120.

Since the superconducting wire has a tape shape, the present invention makes the superconducting wire be wound in a pancake shape. The present invention enables bifilar winding with regard to the characteristics of the superconducting wire, such as curvature.

The main body 110 has a wire insertion groove 111 for receiving the superconducting wire therein. The supporting base 120 has copper block fixing notches 121 and 121' at opposite sides for fixing a respective copper block thereto.

The wire insertion groove 111 has a depth greater than the width of the superconducting wire 200, so that the superconducting wire 200 can be wound in a bifilar manner.

Since the high temperature superconducting wire 200 is made of a ceramic material, if the superconducting wire is wound with a radius of curvature smaller than a predetermined radius of curvature, the characteristics of the superconducting wire 200 abruptly deteriorate. Accordingly, the wire insertion groove 111 has a radius of curvature greater than that of the superconducting wire 200.

Further, the wire insertion groove 111 is structured to guide the superconducting wire 200 from one side to another side of the main body 110 of the bobbin via a center portion so that the superconducting wire 200 is disposed in the main body 110 of the bobbin as its middle portion thereof is bent in a longitudinal direction.

The supporting base 120 is disposed under the main body 110 of the bobbin and has at least one set of block fixing notches 121 and 121'.

Referring to FIG. 2, the superconducting wire is disposed in the wire insertion groove 111 of the bobbin 100 as its middle portion is curved in a longitudinal direction. In this state, referring to FIG. 3, the superconducting wire 200 is wound by using a pair of winding machines 300, maintaining a predetermined tension, in a bifilar manner.

In this instance, the superconducting wire 200 is completely covered with an insulating material.

After the superconducting wire 200 is wound, referring to FIG. 4, copper blocks 400 serving as electrical terminals are installed and fixed to the bobbin 100, and the superconducting wire 200 is in contact with the terminal portions of the copper blocks 400, maintaining a predetermined tension.

That is, in order to join the terminal portion of the copper block with the superconducting wire 200, the copper blocks 400 are installed and fixed to the block fixing notches 121 of the supporting base 120 of the bobbin 100. The copper blocks 400 are joined with the superconducting wire 200 while the superconducting wire 200 maintains its tension.

In this instance, it is preferable that the copper blocks 400 serving as current terminals have a curved surface at the portion in contact with the superconducting wire 200 provided at an end portion of the copper block 400.

The copper block 400 is joined with the superconducting wire 200 by a soldering method using a material having a low melting point, such as indium, in order to minimize deterioration of the characteristics of the wire 200.

Figure 5:
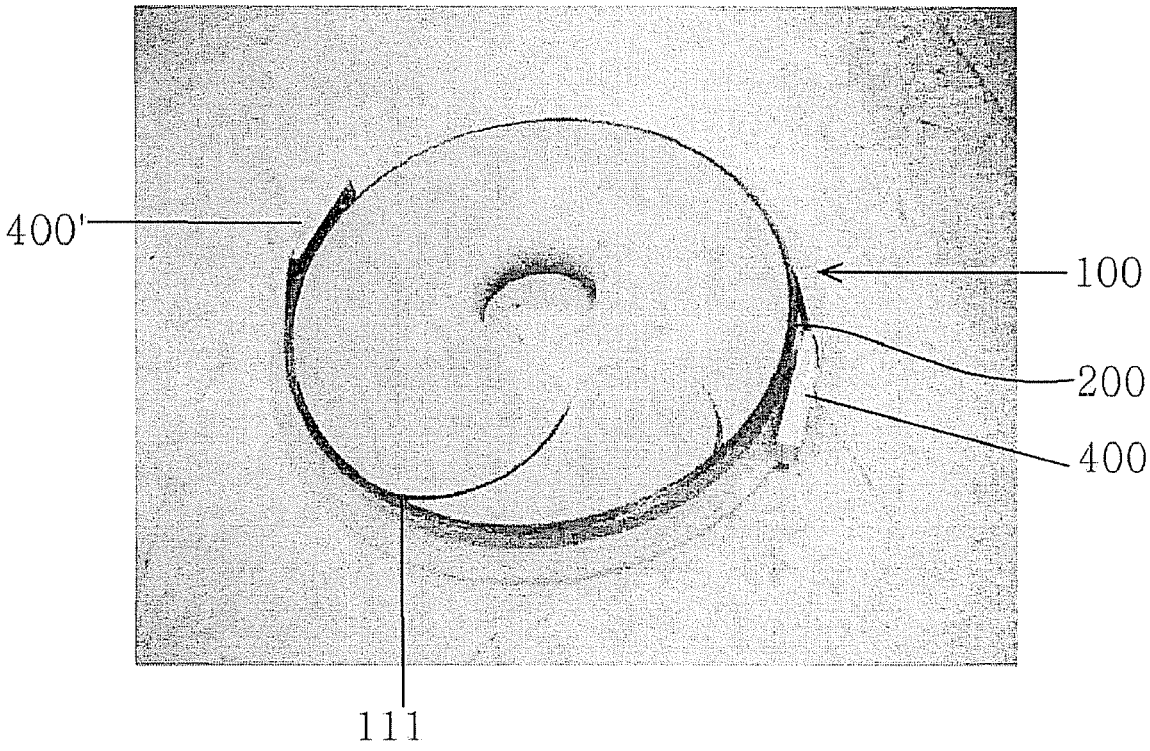
FIG. 5 is a photograph illustrating a bifilar winding module according to one embodiment of the present invention.
Figure 6:
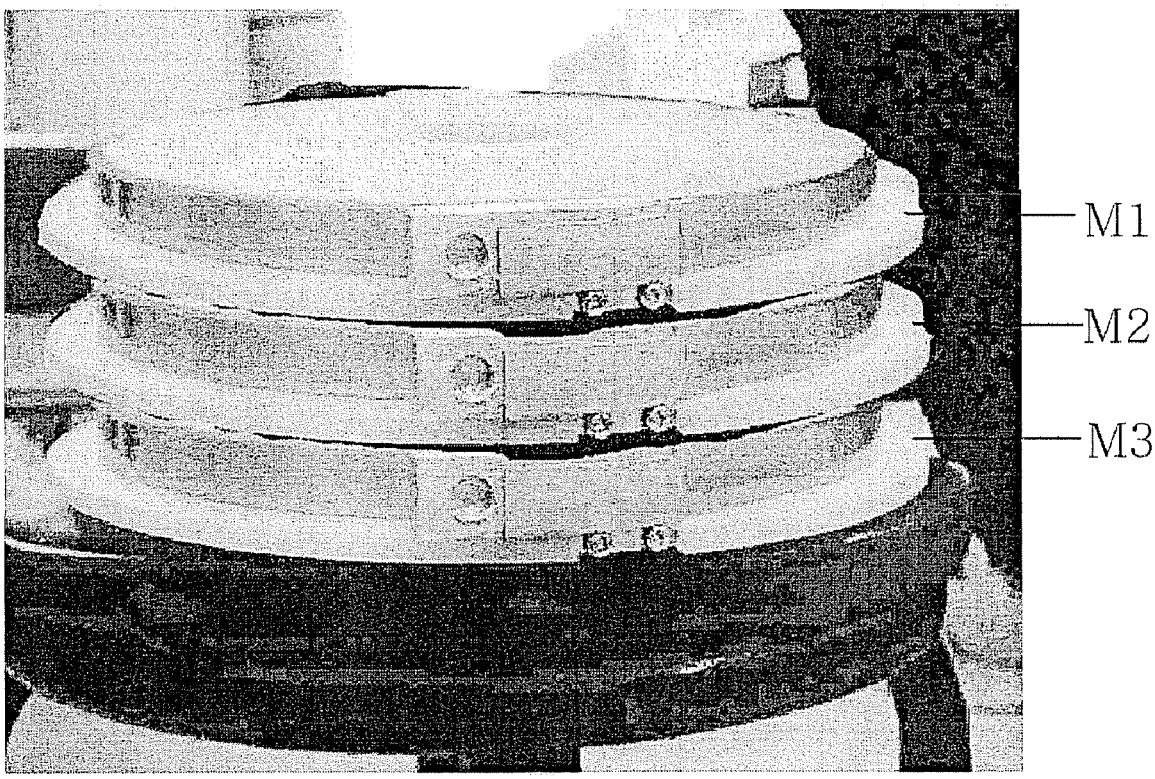
FIG. 6 is a photograph illustrating the state in which a plurality of winding modules is connected.

FIG. 5 illustrates a bifilar winding module according to one embodiment of the present invention, and FIG. 6 illustrates the connection state of the bifilar winding modules.

The bifilar winding module assembled according to the sequence shown in FIGS. 2 to 4 is shown in FIG. 5.

That is, in the bifilar winding module according to the present invention, the superconducting wire 200 is wound passing through the wire insertion groove 111 of the bobbin 100 as its middle portion in the longitudinal direction is bent in the wire insertion groove 111. Both ends of the superconducting wire 200 are fixed to the supporting base of the bobbin 100, in the state of being joined with the copper blocks 400 and 400', serving as electrical terminals.

In order to adjust the capacity and size of the superconducting wire 200, a plurality of bifilar winding modules M1, M2 and M3 can be stacked as shown in FIG. 6, and can be connected in series.

Accordingly, due to the stacking of the bifilar winding modules as shown in FIG. 6, the length of the winding can be increased.

Figure 7:
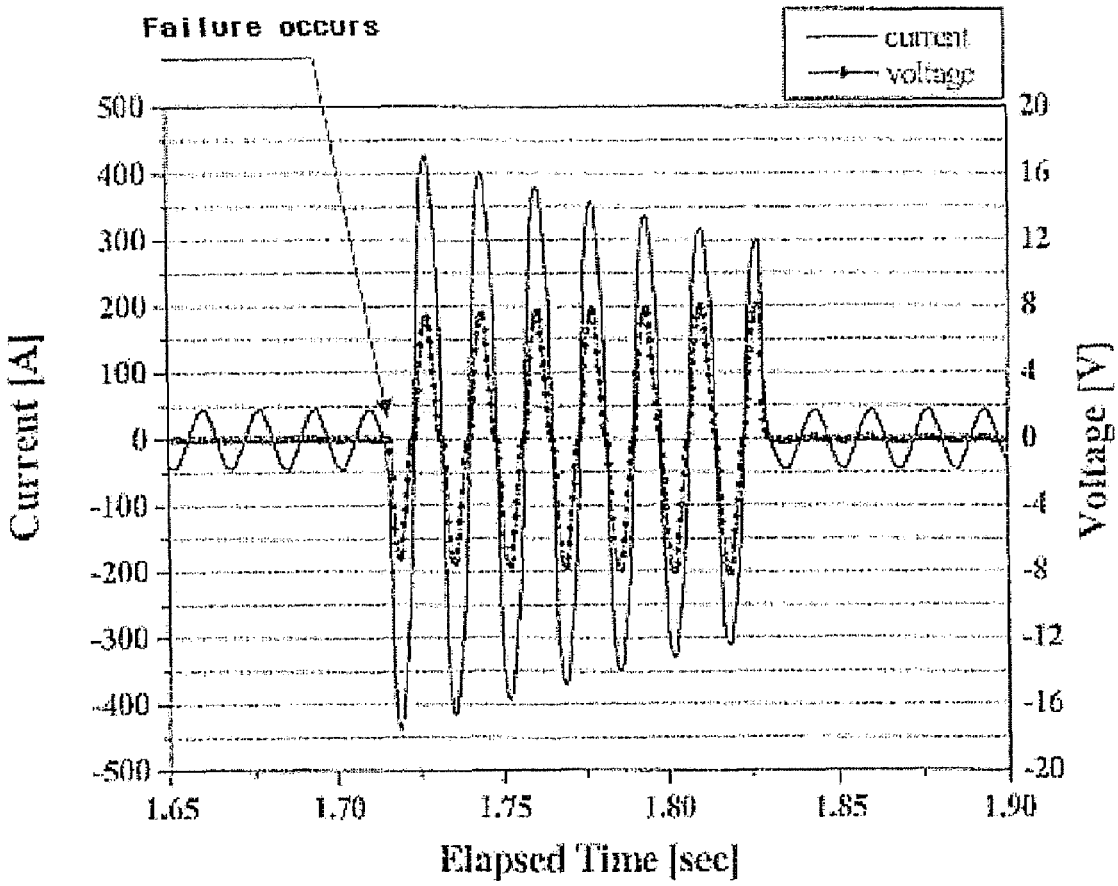
FIG. 7 is a graph showing a circuit disconnection test result of a superconducting fault current limiter using a high temperature superconducting wire having a length of eight meters.

FIG. 7 illustrates a graph showing the result of a short-circuit test of a superconducting fault current limiter using a high temperature superconducting wire eight meters long.

In the graph, the current is current in a simulated system, and the voltage is voltage generated across two end terminals of the manufactured fault current limiter.

As shown in FIG. 7, in the short-circuit test of a superconducting fault current limiter manufactured by using a high temperature superconducting wire eight meters long, the current is maintained at 35 $A_{rms}$ before a short-circuit occurs and the voltage between both terminals of the fault current limiter is 0.

That is, before the occurrence of a failure, there is no voltage drop through the fault current limiter. This means that there is no loss in the fault current limiter during normal operation of the system. However, after a failure occurs, the voltage across the two terminals of the fault current limiter is about $6V_{rms}$. This means that the fault current limiter generates high resistance when system failure occurs and almost of all the voltage in the simulated system is applied to the fault current limiter.

Further, after the occurrence of a system failure, it is observed that the current is abruptly limited by the resistance generated due to the fault current limiter.

According to the present invention described above, the pancake-type bifilar winding module using a superconducting wire is advantageous in that it can be used to manufacture a superconducting fault current limiter using a superconducting wire which can be easily manufactured, is commercially available and windable, and has an easily adjustable capacity and size. Further, the pancake-type bifilar winding module can be designed in a variety of ways, in which the winding of the superconducting wire can be structured to have minimal inductance since the superconducting wire is wound to have a pancake shape in a bifilar winding manner.

Further, since it is possible to manufacture a superconducting fault current limiter using the bifilar winding module according to the present invention, if the fault current limiter is joined with a conventional power system, fault current can be drastically reduced, the replacement period of a circuit breaker is reduced, and impedance loss is remarkably reduced during normal operation, in comparison with the cases in which a conventional fault current limiter using different materials is used because the winding module has the least inductance.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A pancake-type bifilar winding module, comprising:

a bobbin including a cylindrical main body having a wire insertion groove for winding a superconducting wire in a bifilar manner to have minimal inductance, in which the wire insertion groove has a depth greater than a width of the superconducting wire and a radius of curvature greater than a predetermined value, and is structured to guide the superconducting wire from one side to another side of the body, and a cylindrical supporting base having at least one block fixing notch and being disposed under the main body;

the superconducting wire wound in a bifilar manner, maintaining a predetermined tension as it is disposed in the wire insertion groove of the bobbin and curved in the middle portion thereof in a longitudinal direction; and a copper block serving as an electrical terminal, which is installed and fixed to the block fixing notch of the supporting base of the bobbin for joining the superconducting wire with a terminal portion, and joined with the superconducting wire while the superconducting wire maintains a predetermined tension.

2. A pancake-type bifilar winding module, comprising a plurality of bifilar winding modules, each including:

a bobbin including a cylindrical main body having a wire insertion groove for winding a superconducting wire in a bifilar manner to have minimal inductance, in which the wire insertion groove has a depth greater than a width of the superconducting wire and a radius of curvature greater than a predetermined value, and is structured to guide the superconducting wire from one side to another side of the body, and a cylindrical supporting base having at least one block fixing notch and being disposed under the main body;

the superconducting wire wound in a bifilar manner, maintaining a predetermined tension as it is disposed in the wire insertion groove of the bobbin and curved in the middle portion thereof in a longitudinal direction; and a copper block serving as an electrical terminal, which is installed and fixed to the block fixing notch of the supporting base of the bobbin for joining the superconducting wire with a terminal portion, and joined with the superconducting wire while the superconducting wire maintains a predetermined tension, wherein the bifilar winding modules are stacked in a vertical direction such that the supporting base of an upper bifilar winding module is in contact with the main body of the bobbin of a lower bifilar winding module, so that the superconducting wire of each of the bifilar winding modules are connected in series and thereby the total length of the superconducting wire can be increased.

3. The pancake-type bifilar winding module as claimed in claim 1, wherein the superconducting wire is completely covered with an insulating material.

4. The pancake-type bifilar winding module as claimed in claim 1, wherein the copper block serving as a current terminal is joined with the superconducting wire by a material having a low melting point using a soldering method in order to minimize deterioration of the characteristics of the superconducting wire.

5. The pancake-type bifilar winding module as claimed in claim 1, wherein the copper block serving as an electrical terminal has a contact surface at an end thereof, the contact surface being curved and being in contact with the superconducting wire.

6. A winding bobbin used for bifilar winding in a pancake-type bifilar winding module using a superconducting wire, comprising:

a cylindrical main body having a wire insertion groove for winding a superconducting wire in a bifilar manner to have minimal inductance, in which the wire insertion groove has a depth greater than a width of the superconducting wire and a radius of curvature greater than a predetermined value, and being structured to guide the superconducting wire from one side to another side of the body;

a cylindrical supporting base having at least one block fixing notch and being disposed under the main body; and a copper block serving as an electrical terminal, which is installed and fixed to the block fixing notch of the supporting base for connecting the superconducting wire to a terminal portion thereof.

7. The winding bobbin as claimed in claim 6, wherein the copper block serving as a current terminal has a wire contact surface at one end thereof, in which the wire contact surface is curved and is in contact with the wire.

8. The pancake-type bifilar winding module as claimed in claim 2, wherein the superconducting wire is completely covered with an insulating material.

9. The pancake-type bifilar winding module as claimed in claim 2, wherein the copper block serving as a current terminal is joined with the superconducting wire by a material having a low melting point using a soldering method in order to minimize deterioration of the characteristics of the superconducting wire.

10. The pancake-type bifilar winding module as claimed in claim 2, wherein the copper block serving as an electrical terminal has a contact surface at an end thereof, the contact surface being curved and being in contact with the superconducting wire.

* * * * *